US006972650B2

(12) United States Patent
Ma

(10) Patent No.: US 6,972,650 B2
(45) Date of Patent: Dec. 6, 2005

(54) SYSTEM THAT INCLUDES AN ELECTRODE CONFIGURATION IN A MEMS SWITCH

(75) Inventor: Qing Ma, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/971,793

(22) Filed: Oct. 22, 2004

(65) Prior Publication Data

US 2005/0083158 A1 Apr. 21, 2005

Related U.S. Application Data

(62) Division of application No. 10/219,013, filed on Aug. 14, 2002, now Pat. No. 6,850,133.

(51) Int. Cl.[7] ..... H01H 51/22
(52) U.S. Cl. ..... 335/78; 200/181
(58) Field of Search ..... 335/78; 200/181; 361/257, 235, 233

(56) References Cited

U.S. PATENT DOCUMENTS

| | | | | |
|---|---|---|---|---|
| 5,638,946 | A | 6/1997 | Zavracky | 200/181 |
| 5,677,823 | A | 10/1997 | Smith | 361/234 |
| 5,880,921 | A | 3/1999 | Tham et al. | 361/233 |
| 6,143,997 | A | 11/2000 | Feng et al. | 200/181 |
| 6,307,452 | B1 | 10/2001 | Sun | 333/262 |
| 6,376,787 | B1 | 4/2002 | Martin et al. | 200/181 |
| 6,433,657 | B1 | 8/2002 | Chen | 333/262 |
| 6,486,425 | B2 | 11/2002 | Seki | 200/181 |
| 6,529,093 | B2 | 3/2003 | Ma | 333/101 |
| 6,621,387 | B1 | 9/2003 | Hopcroft | 333/262 |
| 6,633,212 | B1 | 10/2003 | Ruan et al. | 335/78 |
| 6,646,215 | B1 | 11/2003 | Nelson | 200/181 |
| 6,657,525 | B1 | 12/2003 | Dickens et al. | 335/78 |
| 2003/0080839 | A1 | 5/2003 | Wong | 335/78 |
| 2003/0090350 | A1 | 5/2003 | Feng et al. | 335/78 |
| 2003/0132823 | A1 | 7/2003 | Hyman et al. | 335/78 |

FOREIGN PATENT DOCUMENTS

| | | | |
|---|---|---|---|
| EP | 1308977 | 5/2003 | H01H 59/00 |
| JP | 20-113792 | 4/2000 | H01H 59/00 |

OTHER PUBLICATIONS

Muldavin, Jeremy B., et al., "Inline Capacitive and DC-Contact MEMS Shunt Switches", *Submitted to the IEEE Microwave and Wireless Components Letter,* (Feb. 15, 2001), 1-3.

*Primary Examiner*—Elvin G. Enad
*Assistant Examiner*—Bernard Rojas
(74) *Attorney, Agent, or Firm*—Schwegman, Lundberg, Woessner & Kluth, P.A.

(57) ABSTRACT

A microelectromechanical system (MEMS) switch that includes a signal contact, an actuation electrode and a beam that engages the signal contact when a voltage is applied to the actuation electrode. The signal contact includes a first portion and a second portion. The actuation electrode is positioned between the first and second portions of the signal contact.

23 Claims, 7 Drawing Sheets

SYSTEM THAT INCLUDES AN ELECTRODE CONFIGURATION IN A MEMS SWITCH

This application is a divisional of U.S. patent application Ser. No. 10/219,013, filed on Aug. 14, 2002, now issued as U.S. Pat. No. 6,850,133, which is incorporated herein by reference.

TECHNICAL FIELD

Microelectromechanical systems (MEMS), and in particular to MEMS switches that have an improved electrode configuration.

BACKGROUND

A microelectromechanical system (MEMS) is a microdevice that integrates mechanical and electrical elements on a common substrate using microfabrication technology. The electrical elements are formed using known integrated circuit fabrication techniques, while the mechanical elements are fabricated using lithographic techniques that selectively micromachine portions of a substrate. Additional layers are often added to the substrate and then micromachined until the MEMS device is in a desired configuration. MEMS devices include actuators, sensors, switches, accelerometers, and modulators.

MEMS switches have intrinsic advantages over conventional solid-state counterparts such as field-effect transistor switches. The advantages include low insertion loss and excellent isolation. However, MEMS switches are generally much slower than solid-state switches. This speed limitation precludes applying MEMS switches in certain technologies, such as wireless communications, where sub-microsecond switching is required.

One type of MEMS switch includes a suspended connecting member, or beam, that is electrostatically deflected by energizing an actuation electrode. The deflected beam engages one or more electrical contacts to establish an electrical connection between isolated contacts. A beam anchored at one end while suspended over a contact at the other end is called a cantilevered beam. A beam anchored at opposite ends and suspended over one or more electrical contacts is called a bridge beam.

FIGS. 1–3 illustrate a prior art MEMS switch 10 that includes a bridge beam 12. Beam 12 is made up of structural portions 14 and a flexing portion 16. MEMS switch 10 further includes a pair of actuation electrodes 18A, 18B and a pair of signal contacts 20A, 20B that are each mounted onto a base 22.

Beam 12 is mounted to base 22 such that flexing portion 16 of beam 12 is suspended over actuation electrodes 18A, 18B and signal contacts 20A, 20B. Signal contacts 20A, 20B are not in electrical contact until a voltage is applied to the actuation electrodes 18A, 18B. As shown in FIG. 2, applying a voltage to actuation electrodes 18A, 18B causes the flexing portion 16 of beam 12 to move down until protuberances 21 on the flexing portion 16 engage signal contacts 20A, 20B to electrically connect signal contacts 20A, 20B. In other types of MEMS switches, signal contacts 20A, 20B are always electrically connected such that beam 12 acts as a shunt when beam 12 engages signal contacts 20A, 20B.

One drawback associated with MEMS switch 10 is that there is significant resistance between protuberances 21 on beam 12 and the pads that form signal contacts 20A, 20B. The considerable resistance between protuberances 21 and signal contacts 20A, 20B causes excessive insertion losses within MEM switch 10.

FIGS. 4 and 5 illustrate another prior art MEMS switch 30 that includes a bridge beam 32. MEMS switch 30 is similar to MEMS switch 10 in FIG. 1 in that MEMS switch 30 also includes a beam 32 that is made up of structural portions 34 and a flexing portion 36. MEMS switch 30 similarly includes a pair of actuation electrodes 38A, 38B and a pair of signal contacts 40A, 40B that are each mounted onto a base 42. Flexing portion 36 of beam 32 is suspended over actuation electrodes 38A, 38B and signal contacts 40A, 40B such that when a voltage is applied to actuation electrodes 38A, 38B, multiple protuberances 41 on flexing portion 36 move downward to engage signal contacts 40A, 40B.

MEMS switch 30 attempts to address the resistance problems associated with MEMS switch 10 by using more protuberances 41 on beam 32. The drawback with adding additional protuberances is that only a few of the protuberances 41 actually establish good electrical contact with signal contacts 20A, 20B. The remaining protuberances are in poor electrical contact with signal contacts 20A, 20B or do not even engage signal contacts 20A, 20B. Therefore, MEMS switch 30 still has considerable insertion loss.

FIGS. 6 and 7 illustrate a more recent prior art MEMS switch 50 that includes a bridge beam 52. MEMS switch 50 is similar to MEMS switches 10, 30 in FIGS. 1–4 in that MEMS switch 50 also includes a beam 52 that is made up of structural portions 54 and a flexing portion 56. MEMS switch 50 includes an actuation electrode 58 that is positioned below a surface 61 of base 66. Actuation electrode 58 extends below a pair of signal contacts 60A, 60B that are each mounted onto base 66. Signal contacts 60A, 60B include projections 62 that extend from respective bodies 63. The flexing portion 56 of beam 52 is suspended over projections 62 such that when actuation electrode 58 applies a voltage, multiple protuberances 65 on flexing portion 56 move downward to engage projections 62.

Placing actuation electrode 58 under projections 62 surrounds each protuberance 65 with pulling force when a voltage is applied to actuation electrodes 58. The space between projections 62 on each signal contact 60A, 60B further enhances the surrounding effect of the force generated by actuation electrode 58.

During operation of MEMS switch 50, the pulling force surrounding each protuberance 65 facilitates contact between each protuberance 65 and signal contacts 60A, 60B. The improved contact between protuberances 65 and signal contacts 60A, 60B minimizes insertion loss within MEMS switch 50.

One drawback associated with MEMS switch 50 is a greater distance between actuation electrode 58 and beam 52 as compared to other MEMS switches. The increased distance between actuation electrode 58 and beam 52 requires a much larger actuation voltage to be applied to actuation electrode 58 in order to manipulate beam 52. Increased actuation voltage is undesirable because more equipment and/or power are required to operate MEMS switch 50. The necessary additional equipment and power are especially problematic when MEMS switches are used in portable electronic devices powered by batteries.

DETAILED DESCRIPTION

In the following detailed description reference is made to the accompanying drawings in which is shown by way of illustration specific embodiments. These embodiments are described in sufficient detail to enable those skilled in the art to practice the embodiments of invention. Other embodiments may be utilized and/or changes made to the illustrated embodiments.

Figure 1:
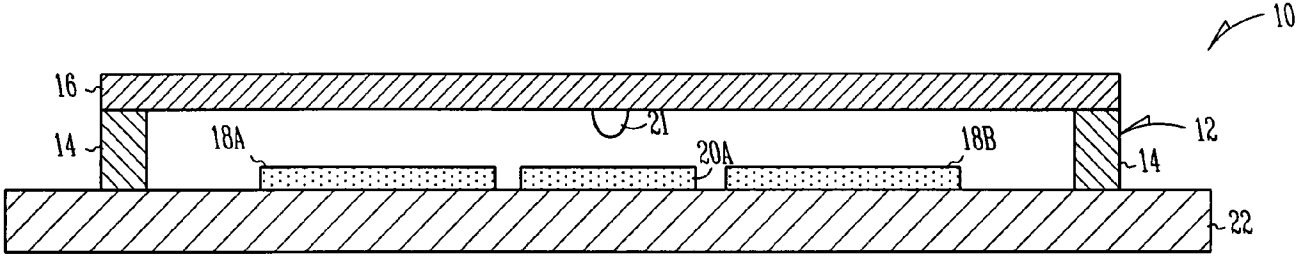
Fig. 1 (PRIOR ART)
FIG. 1 illustrates a prior art MEMS switch.
Figure 2:
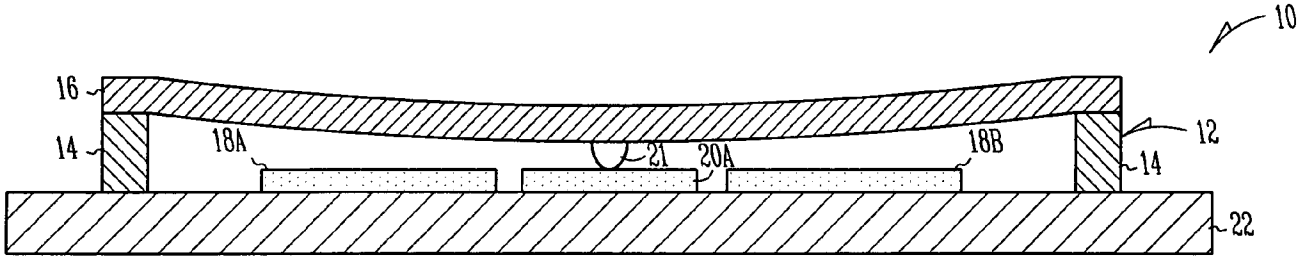
Fig. 2 (PRIOR ART)
FIG. 2 illustrates the prior art MEMS switch of FIG. 1 during operation.
Figure 3:
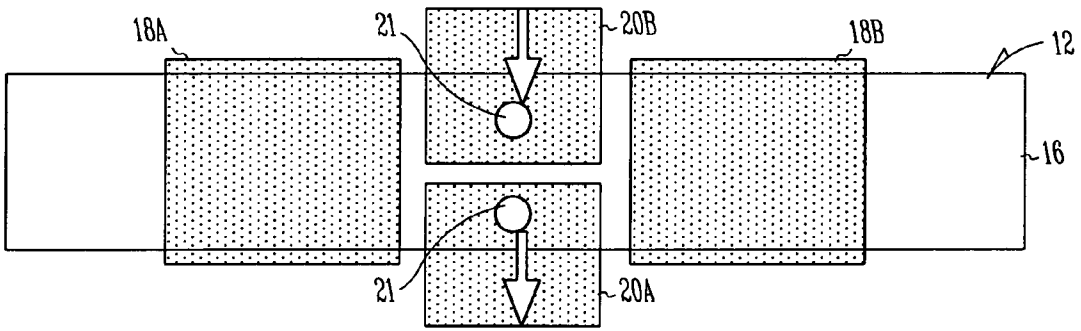
Fig. 3 (PRIOR ART)
FIG. 3 is a top view of the prior art MEMS switch shown FIG. 1 with portions removed and portions shown in phantom.
Figure 4:
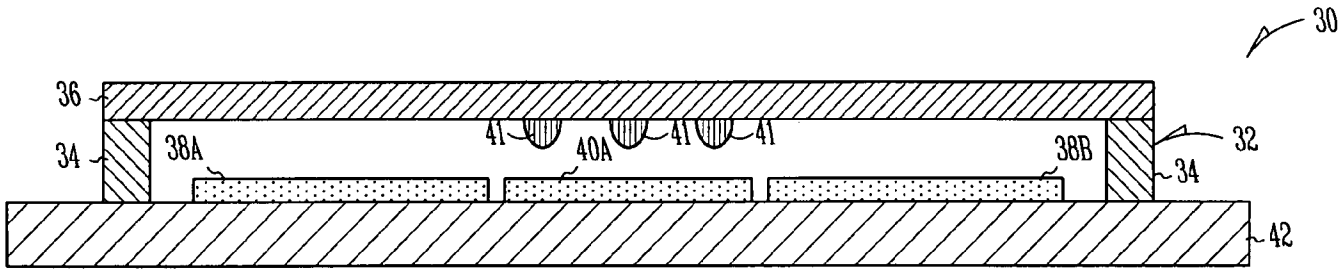
Fig. 4 (PRIOR ART)
FIG. 4 illustrates another prior art MEMS switch.
Figure 5:
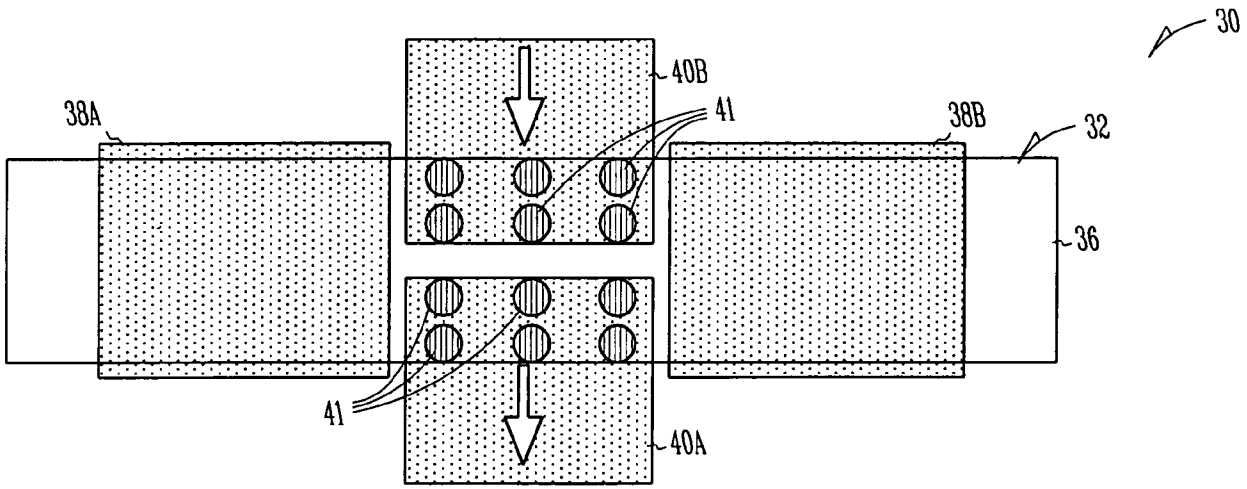
Fig. 5 (PRIOR ART)
FIG. 5 is a top view of the prior art MEMS switch shown FIG. 4 with portions removed and portions shown in phantom.
Figure 6:
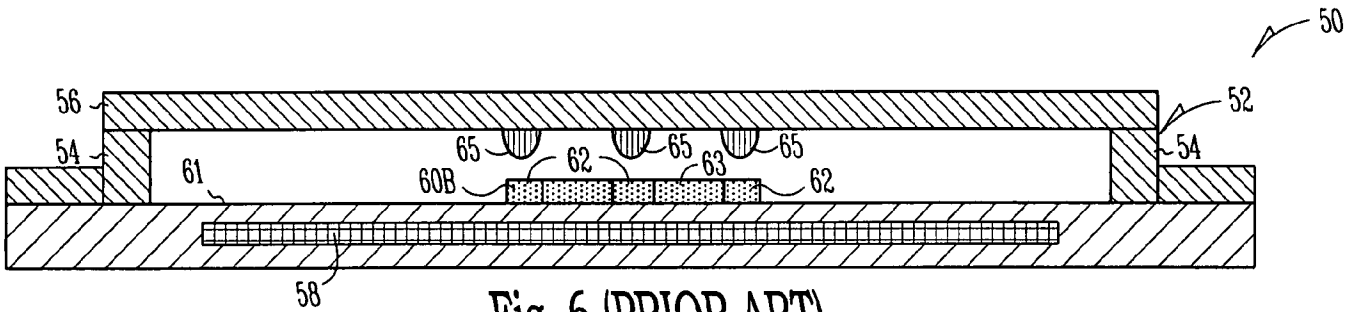
Fig. 6 (PRIOR ART)
FIG. 6 illustrates anther prior art MEMS switch.
Figure 7:
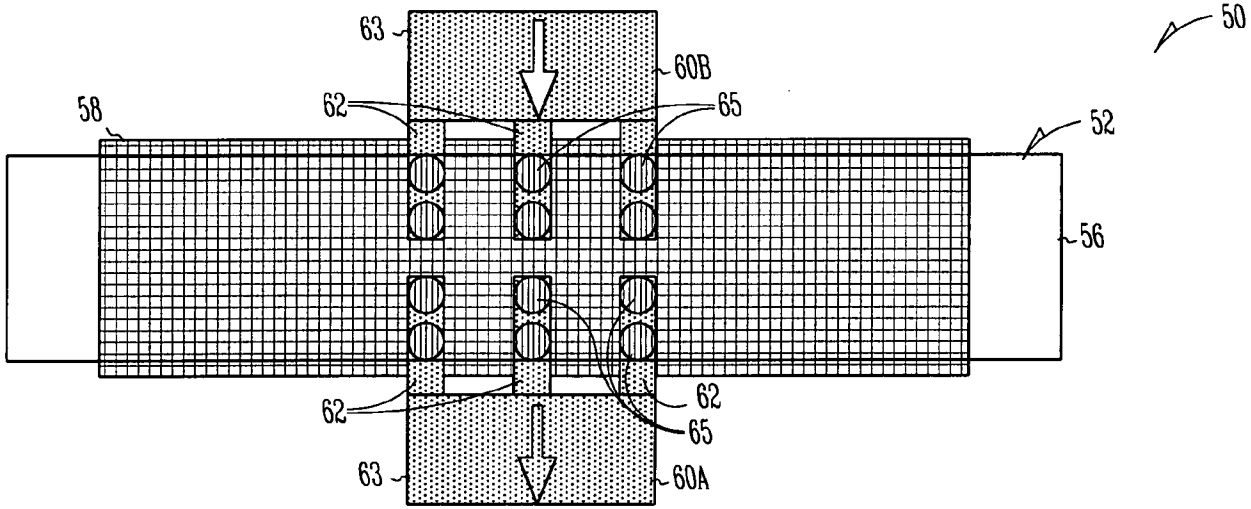
Fig. 7 (PRIOR ART)
FIG. 7 is a top view of the prior art MEMS switch shown FIG. 6 with portions removed and portions shown in phantom.
Figure 8:
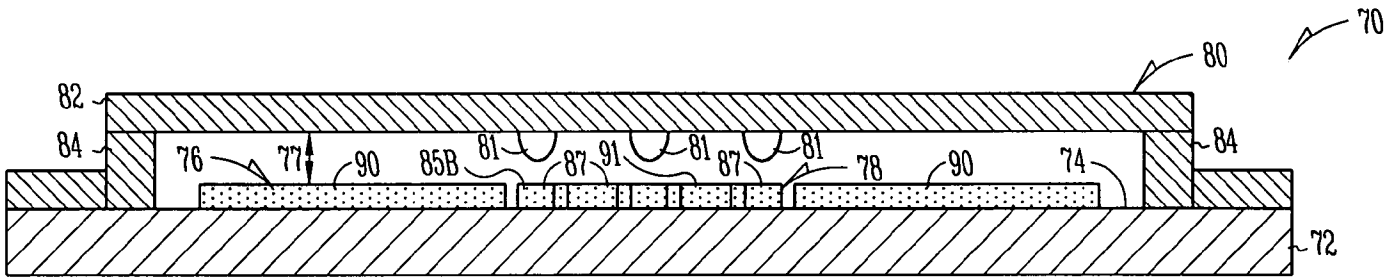
FIG. 8 illustrates a MEMS switch.
Figure 9:
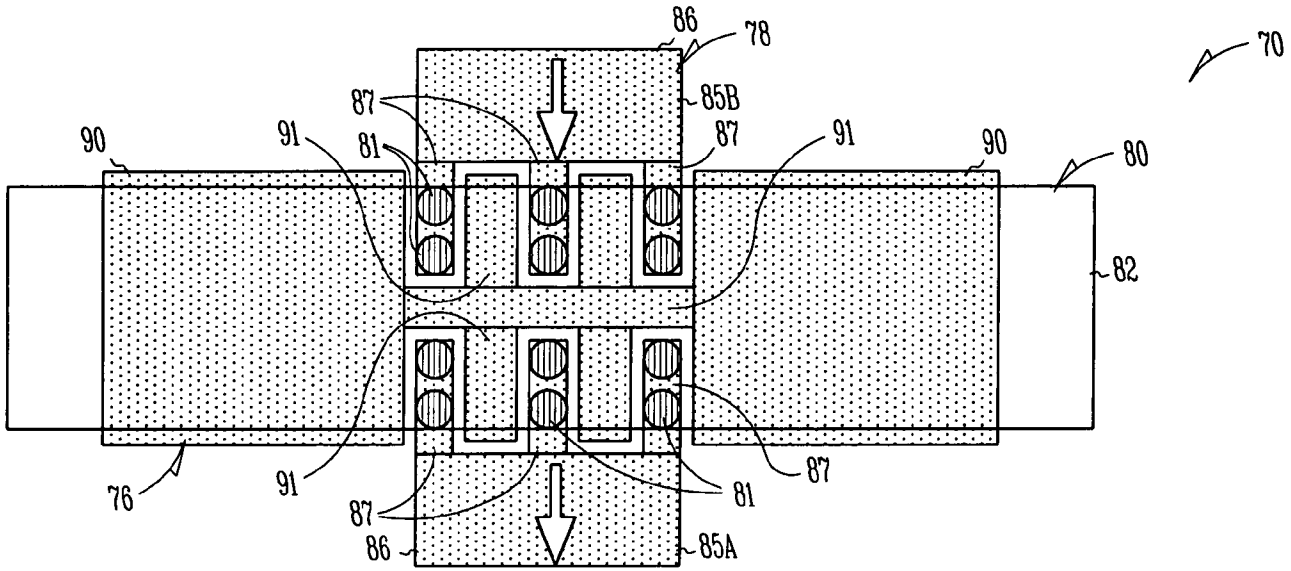
FIG. 9 is a top view of the MEMS switch shown FIG. 8 with portions removed and portions shown in phantom.

FIGS. 8 and 9 show a MEMS switch 70. MEMS switch 70 includes a substrate 72 with an upper surface 74. The substrate 72 may be part of a chip or any other electronic device. An actuation electrode 76 and a signal contact 78 are formed on the upper surface 74 of substrate 72. The actuation electrode 76 and signal contact 78 are electrically connected with other electronic components via conducting traces in the substrate 72, or through other conventional means.

Switch 70 further includes a bridge beam 80 having a flexible portion 82 supported at both ends by structural portions 84. It should be noted that in alternative embodiments, beam 80 is suspended over substrate 72 in a cantilevered fashion. Beam 80 is suspended over actuation electrode 76 with a gap 77 between the actuation electrode 76 and beam 80. Gap 77 is sized so that the actuation electrode 76 is in electrostatic communication with beam 80.

Beam 80 is suspended over at least a portion of the signal contact 78 such that gap 77 is also between beam 80 and signal contact 78. In one embodiment, gap 77 is anywhere from 0.5 to 2 microns.

MEMS switch 80 operates by applying a voltage to actuation electrode 76. The voltage creates an attractive electrostatic force between actuation electrode 76 and beam 80 that deflects beam 80 toward the actuation electrode 76. Beam 80 moves toward substrate 72 until protuberances 81 on beam 80 engage signal contact 78 to establish an electrical connection between beam 80 and signal contact 78. In some embodiments, beam 80 engages signal contact 78 directly.

Actuation electrode 76 is positioned between at least two portions of signal contact 78 such that the attractive force generated by actuation electrode 76 encompasses more of the area surrounding each protuberance 81. In some embodiments, actuation electrode 76 is positioned between a first portion and a second portion of signal contact 78. Surrounding more of the area around each protuberance 81 with the attractive force that is generated by actuation electrode 76 facilitates engaging each protuberance 81 with signal contact 78 during operation of switch 70. In addition, the gap 77 between actuation electrode 76 and beam 80 is relatively small such that a relatively low actuation voltage is required to operate switch 70.

In the sample embodiment illustrated in FIGS. 8 and 9, signal contact 78 includes an input contact 85A and an output contact 85B. Each of the input and output contacts 85A, 85B includes a body 86 with projections 87 extending from the respective bodies 86. Projections 87 are positioned under beam 80 in alignment with protuberances 81.

Actuation electrode 76 includes outer pads 90 that are positioned under beam 80 on both sides of signal contact 78. The outer pads 90 are connected by an inner pad 91 that extends between projections 87 on input and output contacts 85A, 85B.

Although input and output contacts 85A, 85B are shown with three projections 87 extending from each body 86 any number of projections may extend from the bodies 86. In addition, in some embodiments projections may extend from only one body 86.

Figure 10:
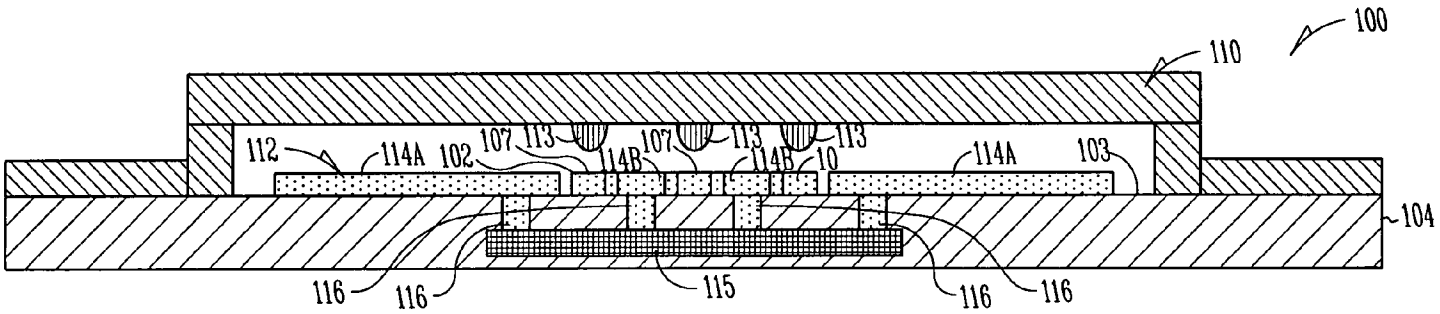
FIG. 10 illustrates another MEMS switch.
Figure 11:
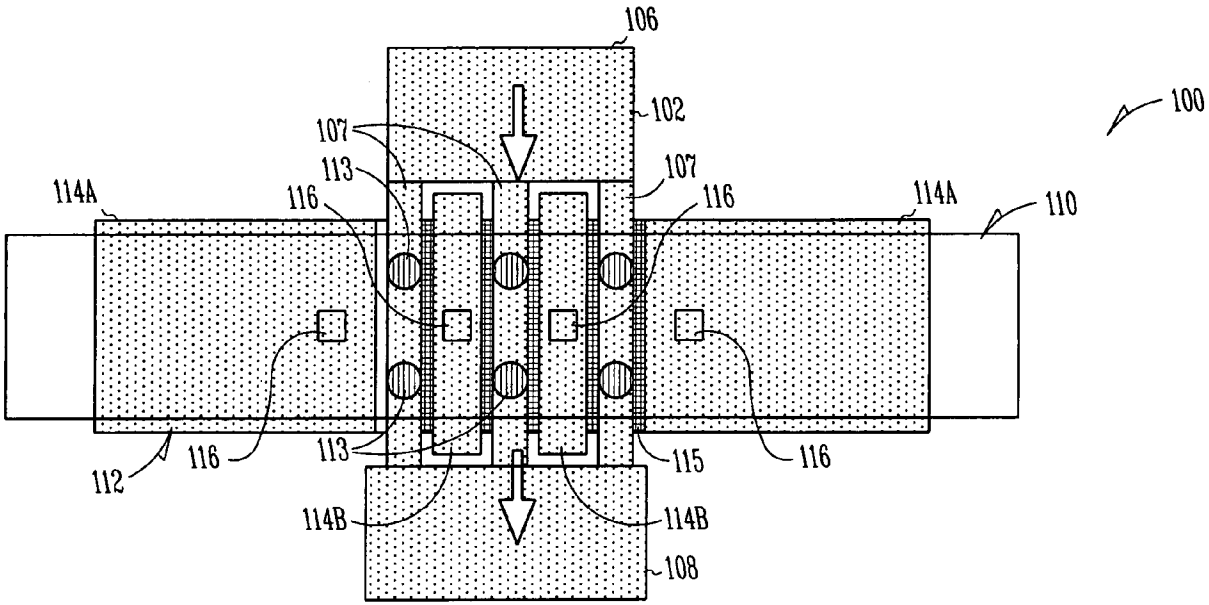
FIG. 11 is a top view of the MEMS switch shown FIG. 10 with portions removed and portions shown in phantom.

FIGS. 10 and 11 illustrate another MEMS switch 100. MEMS switch 100 includes a beam 110 that is similar to beam 80 described above. A signal contact 102 is mounted onto an upper surface 103 of a substrate 104. The signal contact includes an input contact 106 and an output contact 108. The input and output contacts 106, 108 are connected by segments 107 that are at least partly positioned below beam 110.

Beam 110 is electrostatically deflected by an actuation electrode 112 so that protuberances 113 on beam 110 engage segments 107 on signal contact 102 to establish an electrical connection between beam 110 and signal contact 102. When beam 110 is engaged with signal contact 102, beam 110 serves as a shunt for any electric signal passing through signal contact 102. Actuation electrode 112 includes inner pads 114B that are each positioned between pairs of segments 107 on signal contact 102, and outer pads 114A that are positioned outside segments 107. In other example embodiments, signal contact 102 includes two segments and actuation electrode 112 includes a single pad between the two segments.

Inner and outer pads 114A, 114B are electrically coupled together by a connecting pad 115 that is positioned below upper surface 103 of substrate 104. Connecting pad 115 extends below inner and outer pads 114A, 114B and segments 107. Vias 116 electrically couple connecting pad 115 to inner and outer pads 114A, 114B. Since connecting pad 115 is also positioned below beam 110, connecting pad 115 supplements the actuating force applied by the inner and outer pads 114A, 114B during operation of MEMS switch 100.

Figure 12:
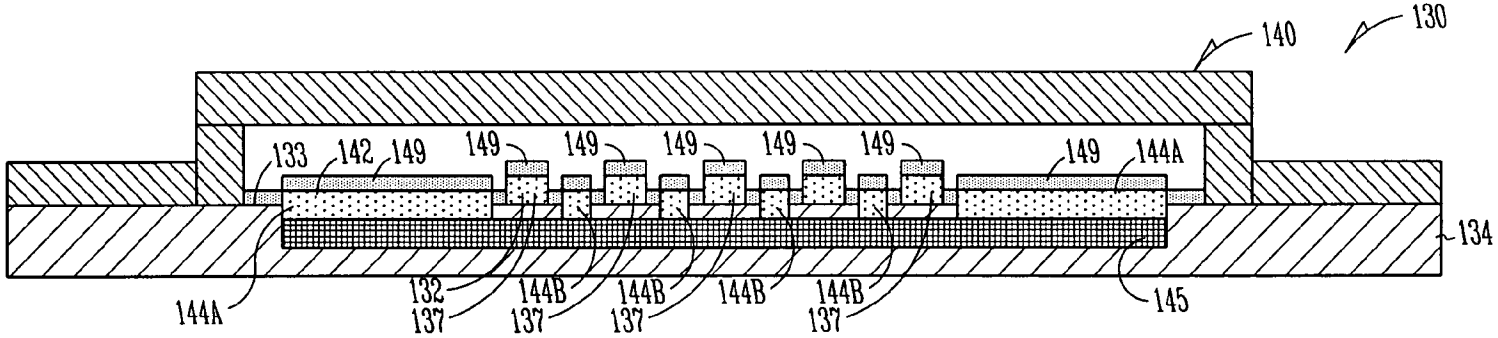
FIG. 12 illustrates another MEMS switch.
Figure 13:
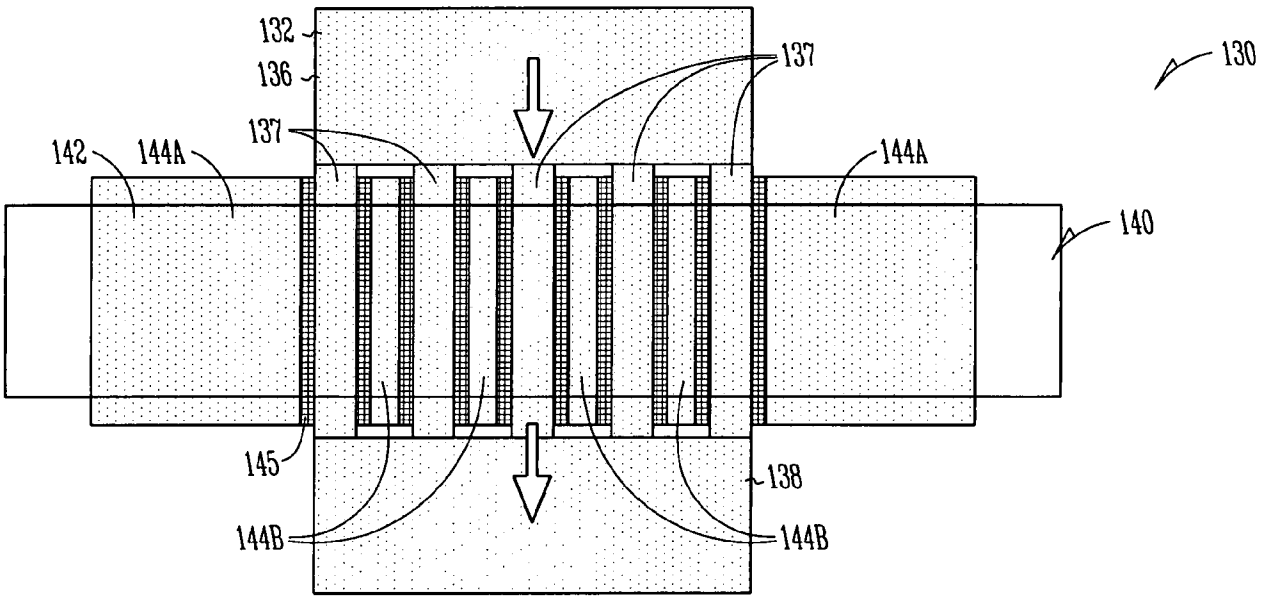
FIG. 13 is a top view of the MEMS switch shown FIG. 12 with portions removed and portions shown in phantom.

FIGS. 12 and 13 illustrate another MEMS switch 130. MEMS switch 130 includes a beam 140 that is similar to beams 80, 110 described above. A signal contact 132 is mounted onto an upper surface 133 of substrate 134. Signal contact 132 includes an input contact 136 and an output contact 138. Input and output contacts 136, 138 are connected by segments 137 that are at least partly positioned below beam 110.

Beam 140 is electrostatically deflected by an actuation electrode 142 so that beam 140 directly engages signal contact 132 to establish an electrical connection between beam 140 and signal contact 132. Actuation electrode 142 includes outer pads 144A that are positioned outside segments 137 and inner pads 144B that are each positioned between a unique pair of segments 137 on signal contact 132.

Inner and outer pads 144A, 144B are electrically coupled together by a connecting pad 145 that is positioned below upper surface 133 of substrate 134. Inner pads 144B are only partially positioned between segments 137 because segments 137 are raised slightly above the level of pads 144A, 144B. Since segments 137 in signal contact 132 are slightly above pads 144A, 144B that make up actuation electrode 142, there is no need for protuberances to placed on beam 140.

Input and output contacts 136, 138, and inner and outer pads 144A, 144B may be covered by a dielectric layer 149. Adding dielectric layer 149 is especially effective when MEMS switch 130 is acting as a high frequency capacitive shunt switch. In other example embodiments, dielectric layer 149 may cover only a portion of signal contact 132 and/or actuation electrode 142.

In any embodiment, the height of any actuation electrode may be less than that of any signal contact so that the beam does not engage the actuation electrode when the beam is deflected. The actuation electrodes and signal contacts may be arranged perpendicular to the longitudinal axis of the beam, parallel to the longitudinal axis of the beam, or have any configuration that facilitates efficient switching. The beam may also have any shape as long as the shape is adequate for a particular application.

MEMS switches provide superior power efficiency, low insertion loss and excellent isolation. Any of the MEMS switches or alternatives described above are highly desirable because they are readily integrated onto a substrate that may be part of another device such as filters or CMOS chips. The tight integration of the MEMS switches reduces power loss, parasitics, size and costs.

Figure 14:
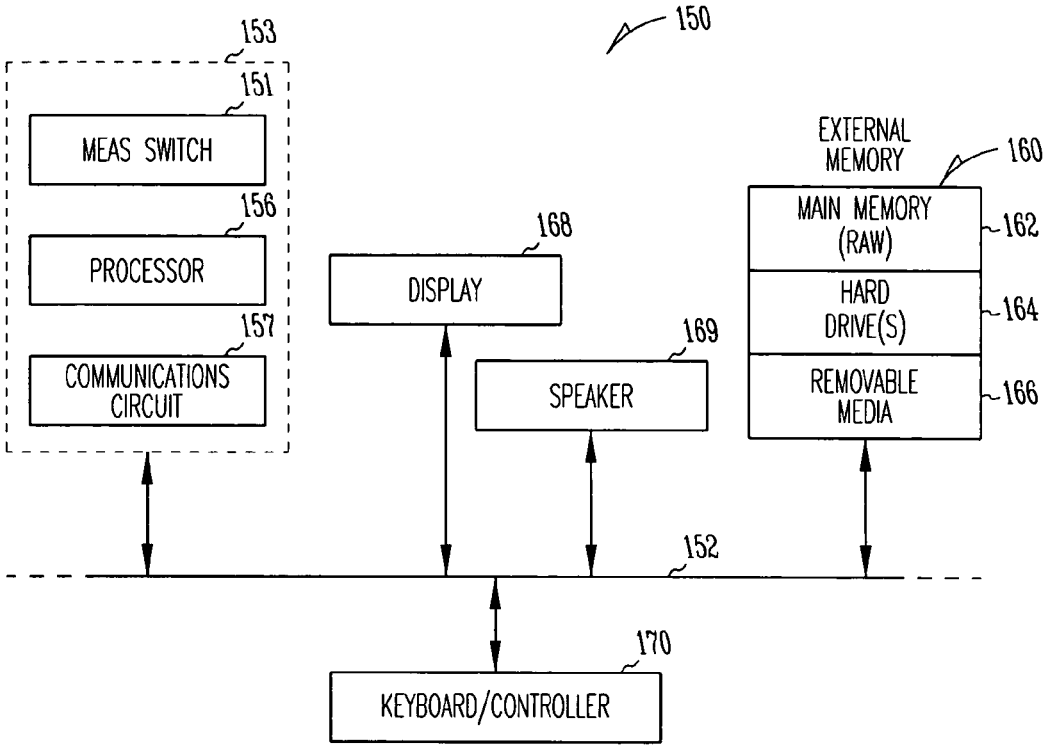
FIG. 14 is a block diagram of an electronic system incorporating at least one MEMS switch.

FIG. 14 is a block diagram of an electronic system 150 incorporating at least one MEMS switch 151, such as MEMS switches 70, 100, 130 illustrated in FIGS. 7–13. Electronic system 150 may be a computer system that includes a system bus 152 to electrically couple the various components of electronic system 150. System bus 152 may be a single bus or any combination of busses.

MEMS switch 151 may be part of an electronic assembly 153 that is coupled to system 152. In one embodiment, electronic assembly 153 includes a processor 156 which can be of any type. As used herein, processor means any type of circuit such as, but not limited to, a microprocessor, a microcontroller, a graphics processor or a digital signal processor.

Other types of circuits that can be included in electronic assembly 153 are a custom circuit or an application-specific integrated circuit, such as communications circuit 157 for use in wireless devices such as cellular telephones, pagers, portable computers, two-way radios, and similar electronic systems.

The electronic system 150 may also include an external memory 160 that in turn may include one or more memory elements suitable to the particular application, such as a main memory 162 in the form of random access memory (RAM), one or more hard drives 164, and/or one or more drives that handle removable media 166, such as floppy diskettes, compact disks (CDs) and digital video disks (DVDs).

The electronic system 150 may also include a display device 168, a speaker 169, and a controller 170, such as a keyboard, mouse, trackball, game controller, microphone, voice-recognition device, or any other device that inputs information into the electronic system 150.

MEMS switch 151 can be implemented in a number of different forms, including an electronic package, an electronic system, a computer system, one or more methods of fabricating an electronic package, and one or more methods of fabricating an electronic assembly that includes the package.

FIGS. 7–13 are representational and are not necessarily drawn to scale. Certain proportions thereof may be exaggerated, while others may be minimized.

What is claimed is:

1. A cell phone comprising:

a bus;

a communications circuit coupled to the bus; and a MEMS switch coupled to the bus, the MEMS switch including a signal contact that has an input contact, an output contact and two segments which electrically connect the input contact to the output contact, the MEMS switch further including an actuation electrode and a beam that engages the signal contact when a voltage is applied to the actuation electrode, the actuation electrode being positioned between the two segments of the signal contact.

2. The cell phone of claim 1, wherein the beam is a bridge beam.

3. The cell phone of claim 1, wherein the beam includes a plurality of protuberances that engage the signal contact.

4. A computer system comprising:

a bus;

a controller coupled to the bus, the controller including a microphone; and a MEMS switch coupled to the bus, the MEMS switch including a signal contact that has an input contact, an output contact and two segments which electrically connect the input contact to the output contact, the MEMS switch further including an actuation electrode and a beam that engages the signal contact when a voltage is applied to the actuation electrode, the actuation electrode being positioned between the two segments of the signal contact.

5. The computer system of claim 4, wherein the input contact is electrically connected to the output contact by a plurality of segments, and the actuation electrode includes a plurality of electrically coupled pads such that each pad is positioned between a unique pair of segments on the signal contact.

6. The computer system of claim 4, wherein the actuation electrode includes an inner pad that is positioned under the beam and between the two segments of the signal contact, and at least one outer pad that is positioned under the beam outside the two segments of the signal contact.

7. The computer system of claim 6, wherein the inner pad is electrically coupled to each outer pad.

8. The computer system of claim 7, wherein the MEMS switch includes a substrate such that the signal contact is on a surface of the substrate.

9. The computer system of claim 8, wherein the inner pad and the at least one outer pad are electrically coupled by a connecting pad positioned below the surface of the substrate.

10. A cell phone comprising:

a bus;

a communications circuit coupled to the bus; and a MEMS switch coupled to the bus, the MEMS switch including a substrate that has a surface and a signal contact on the surface of the substrate, the signal contact including an input contact, an output contact and two segments that electrically connect the input contact to the output contact, the MEMS switch further including an actuation electrode and a beam that engages the signal contact when a voltage is applied to the actuation electrode, the actuation electrode includes an inner pad that is positioned under the beam between the two segments of the signal contact and at least one outer pad that is positioned under the beam outside the two segments of the signal contact.

11. The cell phone of claim 10, wherein the inner pad is electrically coupled to each outer pad.

12. The cell phone of claim 10, wherein the inner pad and the at least one outer pad are electrically coupled by a connecting pad positioned below the surface of the substrate.

13. A computer system comprising:

a bus;

a controller coupled to the bus, the controller including a microphone; and a MEMS switch coupled to the bus, the MEMS switch including a substrate that has a surface and a signal contact on the surface of the substrate, the signal contact including an input contact, an output contact and two segments that electrically connect the input contact to the output contact, the MEMS switch further including an actuation electrode and a beam that engages the signal contact when a voltage is applied to the actuation electrode, the actuation electrode includes an inner pad that is positioned under the beam between the two segments of the signal contact and at least one outer pad that is positioned under the beam outside the two segments of the signal contact.

14. The computer system of claim 13, wherein the inner pad is electrically coupled to each outer pad.

15. The computer system of claim 13, wherein the inner pad and the at least one outer pad are electrically coupled by a connecting pad positioned below the surface of the substrate.

16. A cell phone comprising:

a bus;

a communications circuit coupled to the bus; and a MEMS switch coupled to the bus, the MEMS switch including a substrate that has a surface and a signal contact on the surface of the substrate, the signal contact including an input contact, an output contact and two segments that electrically connect the input contact to the output contact, the MEMS switch further including an actuation electrode and a beam that engages the signal contact when a voltage is applied to the actuation electrode, the actuation electrode including an inner pad that is positioned under the beam between the two segments of the signal contact and at least one outer pad that is positioned under the beam outside the two segments of the signal contact, the inner pad being electrically coupled to the at least one outer pad by a connecting pad positioned below the surface of the substrate.

17. The cell phone of claim 16, wherein the input contact is electrically connected to the output contact by a plurality of segments, and the actuation electrode includes a plurality of electrically connected pads such that each pad is positioned between a unique pair of segments on the signal contact.

18. The cell phone of claim 16, wherein the inner pad and the at least one outer pad are electrically coupled to the connecting pad by vias.

19. The cell phone of claim 16, wherein the beam is a bridge beam that includes a plurality of protuberances which engage the signal contact.

20. A computer system comprising:

a bus;

a controller coupled to the bus, the controller including a microphone; and a MEMS switch coupled to the bus, the MEMS switch including a substrate that has a surface and a signal contact on the surface of the substrate, the signal contact including an input contact, an output contact and two segments that electrically connect the input contact to the output contact, the MEMS switch further including an actuation electrode and a beam that engages the signal contact when a voltage is applied to the actuation electrode, the actuation electrode including an inner pad that is positioned under the beam between the two segments of the signal contact and at least one outer pad that is positioned under the beam outside the two segments of the signal contact, the inner pad being electrically coupled to the at least one outer pad by a connecting pad positioned below the surface of the substrate.

21. The computer system of claim 20, wherein the input contact is electrically connected to the output contact by a plurality of segments, and the actuation electrode includes a plurality of electrically connected pads such that each pad is positioned between a unique pair of segments on the signal contact.

22. The computer system of claim 20, wherein the inner pad and the at least one outer pad are electrically coupled to the connecting pad by vias.

23. The computer system of claim 20, wherein the beam is a bridge beam that includes a plurality of protuberances which engage the signal contact.

* * * * *